US009328402B2

(12) United States Patent
Yamada et al.

(10) Patent No.: US 9,328,402 B2
(45) **Date of Patent: *May 3, 2016**

(54) NICKEL-BASE ALLOY FOR FORGING OR ROLLING AND STEAM TURBINE COMPONENT MADE OF THE SAME

(75) Inventors: Masayuki Yamada, Kangawa (JP); Kiyoshi Imai, Tokyo (JP); Kuniyoshi Nemoto, Kanagawa (JP); Shigekazu Miyashita, Kanagawa (JP); Takeo Suga, Kanagawa (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 373 days.

This patent is subject to a terminal disclaimer.

(21) Appl. No.: 12/854,507

(22) Filed: Aug. 11, 2010

(65) Prior Publication Data

US 2011/0064569 A1 Mar. 17, 2011

(30) Foreign Application Priority Data

Sep. 17, 2009 (JP) ..... 2009-215214
Apr. 19, 2010 (JP) ..... 2010-095940

(51) Int. Cl.
*C22C 19/05* (2006.01)

(52) U.S. Cl.
CPC ..... *C22C 19/055* (2013.01)

(58) Field of Classification Search
CPC ..... C22C 19/055
USPC ..... 148/410; 420/452
See application file for complete search history.

(56) References Cited

U.S. PATENT DOCUMENTS

| | | | | | |
|---|---|---|---|---|---|
| 3,785,877 | A * | 1/1974 | Bailey | 148/556 |
| 4,174,213 | A * | 11/1979 | Fukui et al. | 420/586.1 |
| 4,302,256 | A * | 11/1981 | Kenton | 148/622 |
| 5,476,555 | A * | 12/1995 | Erickson | 148/410 |
| 2005/0236079 | A1 * | 10/2005 | Ueta et al. | 148/675 |
| 2009/0291016 | A1 | 11/2009 | Yamada et al. | |

FOREIGN PATENT DOCUMENTS

| | | | |
|---|---|---|---|
| EP | 1 985 719 | A1 | 10/2008 |
| EP | 2 039 789 | A1 | 3/2009 |
| EP | 2 128 283 | A2 | 12/2009 |
| EP | 2 204 462 | A1 | 7/2010 |
| GB | 1 264 006 | | 2/1972 |
| JP | 2005-2929 | | 1/2005 |
| JP | 2005-097689 | A | 4/2005 |

OTHER PUBLICATIONS

Office Action issued on Feb. 25, 2014 in the corresponding Japanese Patent Application No. 2010-095940.

* cited by examiner

*Primary Examiner* — Jie Yang
(74) *Attorney, Agent, or Firm* — Oblon, McClelland, Maier & Neustadt, L.L.P.

(57) ABSTRACT

In one embodiment, a nickel-base alloy for forging or rolling contains, in weight %, carbon (C): 0.05 to 0.2, silicon (Si) 0.01 to 1, manganese (Mn): 0.01 to 1, cobalt (Co): 5 to 20, iron (Fe): 0.01 to 10, chromium (Cr): 15 to 25, and one kind or two kinds or more of molybdenum (Mo), tungsten (W) and rhenium (Re), with Mo+(W+Re)/2: 8 to 25, the balance being nickel (Ni) and unavoidable impurities.

19 Claims, No Drawings

NICKEL-BASE ALLOY FOR FORGING OR ROLLING AND STEAM TURBINE COMPONENT MADE OF THE SAME

CROSS REFERENCES TO RELATED APPLICATIONS

This application is based upon and claims the benefits of priority from the prior Japanese Patent Applications No. 2009-215214 and No. 2010-095940, filed on Sep. 17, 2009 and Apr. 19, 2010, respectively, all of which are incorporated herein by reference.

BACKGROUND

1. Field

Embodiments described herein relate generally to a Ni-base alloy for forging or rolling and a steam turbine component made of the same and particularly to a Ni-base alloy for forging or rolling and a steam turbine component made of the same that can maintain productivity such as hot workability and weldability as well as improve high-temperature strength.

2. Description of the Related Art

In a thermal power plant including a steam turbine, an art to reduce carbon dioxide emission has been drawing attention in view of global environmental protection, and a need for highly efficient power generation has been increasing.

For higher efficiency of the power generation of a steam turbine, it is effective to increase the temperature of turbine steam. Recently, a thermal power plant including a steam turbine uses the steam whose temperature is equal to or higher than 600° C. The future trend is toward a higher steam temperature up to 650° C., further 700° C., or over 700° C.

High-temperature pipes, flanges, elbows, turbine casings, valve casings and nozzle boxes of the steam turbine into which high-temperature, high-pressure steam flows as a working fluid can be regarded as a kind of a high-temperature pressure vessel receiving a high inner pressure under a high-temperature environment. Therefore, the above components are required to endure high temperature and high stress, and materials for the above components are required to be excellent in strength, ductility and toughness in a high-temperature range. The materials also need to have excellent steam oxidation resistance because of long use at high temperature for a long time.

In the above components, the high-temperature pipe and the flange are almost formed by hot working such as forging, extrusion and drawing. Meanwhile, the elbow, the turbine casing, the valve casing and the nozzle boxes are in many cases formed by casting. However, in order to avoid a reduction in the quality of the components associated with the failure of casting that occurs in the process of casting the components, high-quality cast products may be made by producing an ingot after melting and refining and forging the ingot into the shape of the components. Therefore, the materials applied need to be excellent in hot workability.

The above components constitute part of the turbine and are structurally used in combination with other components. For example, the following components are fitted into the turbine casing: turbine rotors that are rotated by steam, rotor blades, nozzles (stator blades), tie bolts, nozzle boxes and the like. Structural designing is easy when the thermal expansion coefficient of the turbine casing is substantially at the same level as the thermal expansion coefficient of the inner structure components, which also leads to a significant improvement in reliability for long-term operation. Given the fact that the locally-generated thermal stress decreases for large structures as the thermal expansion coefficient is lowered, structural designing becomes easier and long-term reliability improves.

Instead of turning one component into an integrated forging product, the shape of the component may be formed by welding forging segments together. In this case, the segments made of the same material or the segments made of different materials having different chemical compositions may be welded together. Therefore, the materials also need to be excellent in weldability.

At present, typical materials as a Ni-base alloys whose use in the application where the steam temperature is 700° C. or over 700 00° C. is under consideration to the above components are an Inconel 617 alloy (IN617, manufactured by Special Metals Corporation), an Inconel 625 alloy (IN625, manufactured by Special Metals Corporation), an Inconel 740 alloy (IN740, manufactured by Special Metals Corporation), and HR6W (manufactured by Sumitomo Metal Industries, Ltd.)

IN617, IN625 and HR6W are excellent in creep rupture elongation, steam oxidation resistance, hot workability and weldability. However, the creep rupture strengths of IN617, IN625 and HR6W are not sufficient and the thermal expansion coefficients thereof are relatively large. Therefore, the high-temperature components to which the above materials are applied entail difficulty in designing the structures and there are many problems for long-term, stable operation at high temperature. IN740 is excellent in creep rupture strength, steam oxidation resistance and weldability. However, the creep rupture elongation of IN740 is low and the thermal expansion coefficient thereof is relatively large. Therefore, the high-temperature components to which the above material is applied entail difficulty in designing the structures and there are many problems for long-term, stable operation at high temperature.

Moreover, typical materials as a Ni-base alloys whose use in the application of the rotor blades, stator blades and tie bolts at a steam temperature of 700° C. or over 700° C. is under consideration to the above components are an Inconel 713C alloy (IN713C), an Udimet 520 alloy (U520), an Inconel X-750 alloy (X-750), a M252 alloy and an Inconel 718 alloy (IN718). IN713C and U520 are excellent in creep rupture strength. However, the creep rupture elongation of IN713C and U520 is small; IN713C and U520 are not good in hot workability. Even though the thermal expansion coefficient of IN713C is relatively low, IN713C is not good in steam oxidation resistance. Meanwhile, U520 is excellent in steam oxidation resistance. However, the thermal expansion coefficient of U520 is relatively high. X-750 is excellent in creep rupture strength and creep rupture elongation but not good in hot workability and steam oxidation resistance; the thermal expansion coefficient of X-750 is relatively high. M252 is excellent in creep rupture strength, creep rupture elongation and steam oxidation resistance and has a relatively low thermal expansion coefficient. However, M252 is not good in hot workability. IN718 is excellent in creep rupture elongation, hot workability and steam oxidation resistance but not good in creep rupture strength; the thermal expansion coefficient of IN718 is relatively high.

DETAILED DESCRIPTION

As described above, the application of the Ni-base alloy is under consideration as a material for structural components including the high-temperature pipes, flanges, forging elbows, forging turbine casings, forging valve casings, forging nozzle boxes, rotors, rotor blades, stator blades and tie bolts of the steam turbine whose temperature exceeds 700° C. However, it is necessary to further increase the high-temperature strength (creep rupture strength). Moreover, the thermal expansion coefficient needs to be reduced to appropriate levels. The required high-temperature strength and thermal expansion coefficient of the Ni-base alloy are expected to be achieved by improving the composition or doing other things while maintaining the high-temperature ductility (creep rupture elongation), hot workability, steam oxidation resistance, weldability and the like of the Ni-base alloy.

Therefore, it is an object of embodiments to provide a Ni-base alloy for forging or rolling and a steam turbine component made of the same that can increase the creep rupture strength and reduce the thermal expansion coefficient to appropriate levels while maintaining productivity such as hot workability and weldability.

A Ni-base alloy for forging or rolling of embodiments is formed in the composing component ranges shown below. Note that, in the following description, % representing the contents of the composing components refers to weight % unless otherwise mentioned.

In one embodiment, a Ni-base alloy for forging or rolling contains, in weight %, carbon (C): 0.05 to 0.2, silicon (Si): 0.01 to 1, manganese (Mn): 0.01 to 1, cobalt (Co): 5 to 20, iron (Fe): 0.01 to 10, chromium (Cr): 15 to 25, and one kind or two kinds or more of molybdenum (Mo), tungsten (W), and rhenium (Re), with Mo+(W+Re)/2: 8 to 25, the balance being nickel (Ni) and unavoidable impurities.

Hereinafter, many other embodiments will be described.

(M1) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, and one kind or two kinds or more of Mo, W, and Re, with Mo+(W+Re)/2: 8 to 25, the balance being Ni and unavoidable impurities.

(M2) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, and Ti: 0.1 to 2.5, the balance being Ni and unavoidable impurities.

(M3) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, and one kind or two kinds of Nb and Ta, with Nb+Ta/2: 0.5 to 5, the balance being Ni and unavoidable impurities.

(M4) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, and B: 0.001 to 0.02, the balance being Ni and unavoidable impurities.

(M5) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, and Zr: 0.01 to 0.2, the balance being Ni and unavoidable impurities.

(M6) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, and one kind or two kinds of Nb and Ta, with Nb+Ta/2: 0.5 to 5, the balance being Ni and unavoidable impurities.

(M7) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, and B: 0.001 to 0.02, the balance being Ni and unavoidable impurities.

(M8) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, and Zr: 0.01 to 0.2, the balance being Ni and unavoidable impurities.

(M9) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, and B: 0.001 to 0.02, the balance being Ni and unavoidable impurities.

(M10) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, and Zr: 0.01 to 0.2, the balance being Ni and unavoidable impurities.

(M11) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, B: 0.001 to 0.02, and Zr: 0.01 to 0.2, the balance being Ni and unavoidable impurities.

(M12) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, and B: 0.001 to 0.02, the balance being Ni and unavoidable impurities.

(M13) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, and Zr: 0.01 to 0.2, the balance being Ni and unavoidable impurities.

(M14) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, B: 0.001 to 0.02, and Zr: 0.01 to 0.2, the balance being Ni and unavoidable impurities.

(M15) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, one kind or two kinds of Nb and Ta, with Nb+Ta/2: 0.5 to 5, B: 0.001 to 0.02, and Zr: 0.01 to 0.2, the balance being Ni and unavoidable impurities.

(M16) A Ni-base alloy for forging or rolling containing, in weight %, C: 0.05 to 0.2, Si: 0.01 to 1, Mn: 0.01 to 1, Co: 5 to 20, Fe: 0 or 0.01 to 10, Cr: 15 to 25, one kind or two kinds or more of Mo, W, and Re, with Mo+(W+Re)/2: 8 to 25, Al: 0.1 to 0.4, Ti: 0.1 to 2.5, one kind or two kinds of Nb and Ta, with Nb+Ta/2: 0.5 to 5, B: 0.001 to 0.02, and Zr: 0.01 to 0.2, the balance being Ni and unavoidable impurities.

(M17) The Ni-base alloy for forging or rolling corresponding to anyone of the above M1 to M16, in which a content of the Co is 7 to 17 in weight %.

(M18) The Ni-base alloy for forging or rolling corresponding to any one of the above M1 to M17, in which a content of one kind or two kinds or more of the Mo, W, and Re is Mo+(W+Re)/2=13 to 20 in weight %.

(M19) The Ni-base alloy for forging or rolling corresponding to any one of the above M2, M6, M7, M8, M12, M13, M14, and M16, in which a content of the Ti is 0.5 to 2.0 in weight %.

(M20) The Ni-base alloy for forging or rolling corresponding to any one of the above M3, M6, M9, M10, M12, M13, M15 and M16, in which a content of one kind or two kinds of Nb and Ta is Nb+Ta/2=1.0 to 2.5 in weight %.

(M21) The Ni-base alloy for forging or rolling corresponding to any one of the above M4, M7, M9, M11, M12, M14, M15 and M16, in which a content of the B is 0.002 to 0.015 in weight %.

(M22) The Ni-base alloy for forging or rolling corresponding to any one of the above M5, M8, M10, M11, M13, M14, M15 and M16, in which a content of the Zr is 0.02 to 0.10 in weight %.

(M23) The Ni-base alloy for forging or rolling corresponding to any one of the above M1 to M22, in which a content of the Cr is 18 to 23 in weight %.

(M24) The Ni-base alloy for forging or rolling corresponding to any one of the above M1 to M23, in which a content of the Fe is 5 or less in weight %.

(M25) The Ni-base alloy for forging or rolling corresponding to any one of the above M1 to M24, in which a content of the C is 0.07 to 0.15 in weight %.

(M26) The Ni-base alloy for forging or rolling corresponding to any one of the above M2, M6, M7, M8, M12, M13, M14 and M16, in which a content of the Al is 0.2 to 0.3 in weight %.

The Ni-base alloy for forging or rolling in any of the composing component ranges is suitable as structural components for forging or working with plastic deformation, such as high-temperature pipes, flanges, forging elbows, forging turbine casings, forging valve casings, forging nozzle boxes, rotors, rotor blades, stator blades and tie bolts of the steam turbine whose temperature during the operation becomes 680° C. to 750° C.

Here, all parts of the structural components may be entirely made of the Ni-base alloy for forging or rolling, or a part of the structural components whose temperature becomes especially high may be made of the Ni-base alloy for forging or rolling.

Further, the Ni-base alloy for forging or rolling that is within the above composition ranges can improve the high-temperature strength while maintaining the workability, such as hot workability and weldability, of a conventional Ni-base alloy. That is, when structural components, which include the high-temperature pipes, flanges, forging elbows, forging turbine casings, forging valve casings, forging nozzle boxes, rotors, rotor blades, stator blades and tie bolts of the steam turbine, are made of the Ni-base alloy for forging or rolling, it is possible to maintain the hot workability and weldability as well as to improve the high-temperature strength of the structural components, with the structural components having a high level of reliability even under a high-temperature environment.

Next, reasons why each composing component range in the Ni-base alloy for forging or rolling according to the embodiment described above is limited will be described.

(1) C (Carbon)

C is useful as a constituent element of $M_{23}C_6$ type carbide being a strengthening phase, and is one of the factors that, especially under a high-temperature environment Of 650° C., or higher, cause the precipitation of the $M_{23}C_6$ type carbide during the operation of the steam turbine to maintain creep strength of the alloy. Besides, it prevents the coarsening of crystal grains. When a content ratio of C is less than 0.05%, a sufficient precipitation amount of the carbide cannot be ensured. On the other hand, when the content ratio of C is over 0.2%, a component segregation tendency when a large casting is manufactured increases and a generation of $M_6C$ type carbide being an embrittling phase is promoted, causing deterioration in corrosion resistance and ductility. Therefore, the content ratio of C is set to 0.05% to 0.2%. The content ratio is more preferably 0.06% to 0.15%, and most preferably 0.07% to 0.10%.

(2) Cr (Chromium)

Cr not only solid-dissolves in an austenite phase to achieve solid-solution hardening but also is an indispensable element for enhancing oxidation resistance and corrosion resistance. It is also indispensable as a constituent element of the $M_{23}C_6$ type carbide, and especially under a high-temperature environment at 650° C. or higher, it causes the precipitation of the $M_{23}C_6$ type carbide during the operation of the steam turbine, thereby maintaining the creep strength of the alloy. Besides, Cr enhances oxidation resistance under a high-temperature steam environment. When a content ratio of Cr is less than 15%, oxidation resistance deteriorates. On the other hand, when the content ratio of Cr is over 25%, it greatly promotes the precipitation of the $M_{23}C_6$ type carbide, which tends to make the carbide coarser, and after long hours at high temperatures, it causes deterioration in strength and ductility. Further, since Cr increases a thermal expansion coefficient of the alloy, its addition amount in designing a high-temperature machine is preferably lower. Therefore, the content ratio of Cr is set to 15% to 25%. The content ratio is more preferably 18% to 23%, and most preferably 20% to 22%.

(3) Co (Cobalt)

Co solid-dissolves in the austenite phase to improve high-temperature strength. Co, which also solid-dissolves in a γ·phase [$Ni_3$ (Al, Ti, Nb, Ta)], has effects of strengthening the γ·phase and increasing a precipitation amount of the γ·phase. However, a content ratio of Co over 20% becomes factors of generating an intermetallic compound phase to decrease mechanical strength, and of increasing cost of the alloy. On the other hand, when the content ratio of Co is less than 5%, mechanical strength lowers. Therefore, the content ratio of Co is set to 5% to 20%. The content ratio is more preferably 7% to 17%, and most preferably 10% to 14%.

(4) Mo (Molybdenum), W (Tungsten), Re (Rhenium)

Mo, W, and Re all solid-dissolve in the austenite phase to improve high-temperature strength. Further, part thereof is substituted in the $M_{23}C_6$ type carbide to enhance stability of the carbide. They further have an effect of lowering a thermal expansion coefficient of the alloy, which is useful in designing a high-temperature machine. When a content ratio of Mo+(W+Re)/2 is less than 8%, the aforesaid effects are exhibited only a little, and when the content ratio of Mo+(W+Re)/2 is over 25%, the component segregation tendency when a large ingot is manufactured increases and the generation of $M_6C$ type carbide and a σ phase (FeCr) being the embrittling phase is promoted, leading to deterioration in ductility and hot workability. Therefore, the content ratio of Mo+(W+Re)/2 is set to 8% to 25%. The content ratio is more preferably 12% to 20%, and most preferably 15% to 18%.

(5) Al (Aluminum)

Al generates a γ·phase [$Ni_3$(Al, Ti, Nb, Ta)] together with Ni, and causes the precipitation of the γ·phase to improve mechanical strength of the Ni-base alloy. It also has an effect of improving high-temperature corrosion resistance. When a content ratio of Al is less than 0.1%, the precipitation of the γ·phase is not sufficient and the strengthening effect is not exhibited, and if Ti, Nb, and Ta exist in large amount, the γ·phase becomes unstable and a η Phase ($Ni_3Ti$) and a δ phase [$Ni_3$(Pb, Ta)] precipitate, resulting in embrittlement. On the other hand, if the content ratio of Al is over 0.4%, a large amount of a eutectic γ·phase precipitates when a large ingot is manufactured, causing deterioration in high-temperature strength and hot workability. Therefore, the content ratio of Al is set to 0.1% to 0.4%. The content ratio is more preferably 0.2% to 0.3%, and most preferably 0.21% to 0.25%.

(6) Ti (Titanium)

Similarly to Al, Ti generates the γ·phase [$Ni_3$(Al, Ti, Nb, Ta)] together with Ni, and causes the precipitation of the γ·phase to improve mechanical strength of the Ni-base alloy. Ti also has an effect of decreasing a thermal expansion coefficient of the alloy, which is useful in designing a high-temperature machine. When a content ratio of Ti is less than 0.1%, the aforesaid effects are not exhibited, and when the content ratio of Ti is over 2.5%, the precipitation of the a phase (FeCr) and the η Phase ($Ni_3Ti$) as the embrittling phase is promoted, leading to deterioration in high-temperature strength and increase in notch sensitivity. Therefore, the content ratio of Ti is set to 0.1% to 2.5%. The concentration is more preferably 0.5% to 2.0%, and most preferably 1.0% to 1.6%.

(7) B (Boron)

B enters a grain boundary to improve high-temperature strength. Further, when an amount of Ti is large, the precipitation of the η Phase ($Ni_3Ti$) as the embrittling phase is reduced, so that deterioration in high-temperature strength and ductility is prevented. When a content ratio of B is less than 0.001%, the aforesaid effects are not exhibited, and when the content ratio of B is over 0.02%, intergranular embrittlement is caused, which may possibly result in deterioration in high-temperature strength, toughness and hot workability. Therefore, the content ratio of B is set to 0.001% to 0.02%. The content ratio is more preferably 0.002% to 0.015%, and most preferably 0.005% to 0.012%.

(8) Nb (Niobium), Ta (Tantalum)

Nb and Ta solid-dissolve in the γ·phase [$Ni_3$(Al, Ti, Nb, Ta)] to enhance high-temperature strength, inhibit the coarsening of the γ·phase, and stabilize precipitation intensity. Further, when Nb and Ta are bound to C to form carbide, they contribute to improvement in high-temperature strength. When a content ratio of Nb+Ta/2 is less than 0.5%, the aforesaid effects are not exhibited and when the content ratio of Nb+Ta/2 is over 5%, the δ phase [$Ni_3$(Pb,Ta)] and the σ phase (FeCr) precipitate, resulting in embrittlement. Therefore, the content ratio of Nb+Ta/2 is set to 0.5% to 5%. The content ratio is more preferably 1.0% to 3.7%, and most preferably 1.5% to 2.8%.

(9) Zr (Zirconium)

Similarly to B, Zr enters a grain boundary to improve high-temperature strength. Further, when it is bound to C to form carbide, it contributes to improvement in high-temperature strength. When a content ratio of Zr is less than 0.01%, the aforesaid effects are not exhibited, and when the content ratio of Zr is over 0.2%, high-temperature strength lowers on the contrary and deterioration in ductility is also caused. Therefore, the content ratio of Zr is set to 0.01% to 0.2%. The content ratio is more preferably 0.02% to 0.15%, and most preferably 0.05% to 0.13%.

(10) Fe (Iron)

Fe contributes to a cost reduction of the alloy in a Ni-base alloy. However, if Fe is added over 10%, not only causes deterioration in high-temperature strength but also leads to an increase in a thermal expansion coefficient of the alloy, which is disadvantageous in designing a high-temperature machine. Therefore, a content ratio of Fe is set to 10% or less. The content ratio is more preferably 6% or less, and most preferably 5% or less.

(11) Si (Silicon)

Si is useful as a deoxidizer at the time of dissolution and refining. It also improves oxidation resistance. However, if Si is added over 1%, deterioration in ductility is caused. A proper Si content is set to 0.01% to 1%. The content ratio is more preferably 0.02% Lo 0.5%, and most preferably 0.1% to 0.4%.

(12) Mn (Manganese)

Similarly to Si, Mn is useful as a deoxidizer at the time of dissolution and refining. However, if Mn is added over 1%, deterioration in high-temperature oxidation resistance and deterioration in ductility due to the precipitation of then Phase ($Ni_3Ti$) is caused. A proper Mn content ratio is set to 0.01% to 1%. The content ratio is more preferably 0.1% to 0.4%, and most preferably 0.2% to 0.3%.

EXAMPLES

The following experiments were conducted on a plurality of samples different in chemical composition to prove that the Ni-base alloy for forging or rolling of the present invention is excellent in mechanical properties (or in creep rupture strength and creep rupture elongation, which are typical properties of high-temperature strength), the width of the hot workable temperature range, steam oxidation resistance, the low thermal expansion coefficient and weldability.

(Chemical Composition of Samples)

Table 1 shows the chemical compositions of the Ni-base alloys of examples No. 1 to No. 33 and comparative examples No. 1 to No. 18 as well as conditions for thermal treatment of these alloys. As for the thermal treatment of the examples' Ni-base alloys, the samples to which Al and Ti are not added were subjected only to a solution heat treatment (1,100 to 1,200° C.×4 hrs; water cooling); the samples to which Al and Ti are added were subjected to a solution heat treatment (1,100 to 1,200° C.×4 hrs; water cooling) and an aging treatment (700 to 800° C.×16 hrs; air cooling).

In the comparative examples, sample No. 1 has a chemical composition corresponding to that of the conventional alloy of Inconel 740. Sample No. 2 has a chemical composition corresponding to that of the conventional alloy of Inconel 617 (IN617). Sample No. 3 has a chemical composition corresponding to that of the conventional alloy of Inconel 625 (IN625). Sample No. 4 has a chemical composition corresponding to that of the conventional alloy of HR6W. Sample No. 5 has a chemical composition corresponding to that of the conventional alloy of Inconel 713C (IN713C). Sample No. 6 has a chemical composition corresponding to that of the conventional alloy of Udimet 520 (U520). Sample No. 7 has a chemical composition corresponding to that of the conventional alloy of Inconel X-750 (X-750). Sample No. 8 has a chemical composition corresponding to that of the conventional alloy of M252. Sample No. 9 has a chemical composition corresponding to that of the conventional alloy of Inconel 718 (IN718). For the samples of the comparative examples, typical conditions for thermal treatment of the alloys are used.

TABLE 1

| | No. | Co | Fe | Cr | Mo | W | Re | Al | Ti | Nb | Ta | C | B | Zr | Si | Mn | Ni | Mo+ (W + Re)/2 | Nb+ Ta/2 |
|---|---|---|---|---|---|---|---|---|---|---|---|---|---|---|---|---|---|---|---|
| Example | 1 | 7.6 | 4.6 | 22.1 | 13 | 5.8 | 0.32 | — | — | — | — | 0.07 | — | — | 0.32 | 0.22 | b | 16.06 | 0 |
| | 2 | 12.8 | 5 | 23.1 | 12.8 | — | — | — | — | — | — | 0.07 | — | — | 0.29 | 0.24 | b | 12.8 | 0 |
| | 3 | 13 | 5 | 21.6 | 13.1 | 6.2 | — | — | — | — | — | 0.06 | — | — | 0.31 | 0.26 | b | 16.2 | 0 |
| | 4 | 13 | 4.9 | 22.1 | 13.3 | 6.1 | — | — | — | — | — | 0.09 | — | — | 0.3 | 0.32 | b | 16.35 | 0 |
| | 5 | 13.1 | 5.4 | 22 | 12.6 | 5.8 | 0.22 | — | — | — | — | 0.06 | — | — | 0.33 | 0.28 | b | 15.61 | 0 |
| | 6 | 12.6 | 5.2 | 22.5 | 13.1 | 9.8 | 0.2 | — | — | — | — | 0.08 | — | — | 0.29 | 0.26 | b | 18.1 | 0 |
| | 7 | 13.4 | 4.8 | 22.3 | 12.8 | 10.1 | 0.41 | — | — | — | — | 0.07 | — | — | 0.31 | 0.25 | b | 18.055 | 0 |
| | 8 | 12.8 | 5.1 | 20.9 | 13.2 | 6.2 | 0.43 | 0.22 | 0.4 | — | — | 0.07 | — | — | 0.31 | 0.32 | b | 16.515 | 0 |
| | 9 | 13.1 | 5 | 22 | 13 | 6.1 | 0.4 | 0.2 | 1.45 | — | — | 0.07 | — | — | 0.3 | 0.27 | b | 16.25 | 0 |
| | 10 | 13.3 | 5.2 | 21.9 | 12.9 | 5.9 | 0.38 | — | — | 2.2 | — | 0.09 | — | — | 0.33 | 0.28 | b | 16.04 | 2.2 |
| | 11 | 12.6 | 4.8 | 21.6 | 12.7 | 5.7 | 0.37 | — | — | 2.1 | 0.8 | 0.08 | — | — | 0.4 | 0.26 | b | 15.735 | 2.5 |
| | 12 | 12.7 | 4.7 | 22.3 | 12.6 | 6.2 | 0.42 | — | — | 3.2 | 1 | 0.09 | — | — | 0.41 | 0.2 | b | 15.91 | 3.7 |
| | 13 | 13.5 | 5 | 22.7 | 13.3 | 6.5 | 0.41 | — | — | — | — | 0.07 | 0.005 | — | 0.38 | 0.24 | b | 16.755 | 0 |
| | 14 | 13.1 | 5.3 | 22.6 | 13.2 | 5.6 | 0.38 | — | — | — | — | 0.08 | 0.009 | — | 0.38 | 0.22 | b | 16.19 | 0 |
| | 15 | 13.3 | 4.6 | 21.7 | 13.1 | 5.7 | 0.39 | — | — | — | — | 0.07 | — | 0.02 | 0.39 | 0.26 | b | 16.145 | 0 |
| | 16 | 12.7 | 5.2 | 21.8 | 13.1 | 6.1 | 0.36 | — | — | — | — | 0.09 | — | 0.11 | 0.33 | 0.25 | b | 16.33 | 0 |
| | 17 | 12.8 | 5 | 21.9 | 12.4 | 6.4 | 0.18 | 0.21 | 1.44 | 1.9 | 1.1 | 0.08 | — | — | 0.32 | 0.22 | b | 15.69 | 2.45 |
| | 18 | 13.3 | 4.7 | 22.3 | 12.9 | 6.2 | 0.2 | 0.18 | 1.49 | — | — | 0.09 | 0.012 | — | 0.35 | 0.28 | b | 16.1 | 0 |
| | 19 | 12.7 | 5.3 | 22 | 13.3 | 6.1 | 0.17 | 0.19 | 1.43 | — | — | 0.07 | — | 0.12 | 0.39 | 0.23 | b | 16.435 | 0 |
| | 20 | 12.7 | 5.1 | 20.9 | 13.3 | 5.8 | 0.19 | — | — | 1.8 | 1.1 | 0.08 | 0.05 | — | 0.31 | 0.24 | b | 16.295 | 2.35 |
| | 21 | 13.5 | 4.9 | 22.3 | 12.8 | 5.7 | 0.18 | — | — | 1.9 | 1.2 | 0.08 | — | 0.12 | 0.28 | 0.21 | b | 15.74 | 2.5 |
| | 22 | 13.2 | 4.8 | 22.1 | 13 | 5.8 | 0.21 | — | — | — | — | 0.08 | 0.006 | 0.13 | 0.29 | 0.31 | b | 16.005 | 0 |
| | 23 | 12.9 | 5.1 | 21.6 | 12.8 | 6 | 0.2 | 0.2 | 1.53 | 2.3 | 0.9 | 0.07 | 0.005 | — | 0.3 | 0.33 | b | 15.9 | 2.75 |
| | 24 | 12.7 | 5 | 21.9 | 12.7 | 6.2 | 0.22 | 0.22 | 1.51 | 2.1 | 0.8 | 0.09 | — | 0.12 | 0.34 | 0.28 | b | 15.91 | 2.5 |
| | 25 | 12.6 | 4.8 | 22.7 | 12.6 | 5.5 | 0.22 | 0.23 | 1.48 | — | — | 0.07 | 0.006 | 0.13 | 0.37 | 0.26 | b | 15.46 | 0 |
| | 26 | 13.5 | 5.3 | 21.5 | 13.2 | 6.4 | 0.17 | — | — | 2 | 1.1 | 0.09 | 0.005 | 0.12 | 0.42 | 0.27 | b | 16.485 | 2.55 |
| | 27 | 13.2 | 4.9 | 21.6 | 13.3 | 6.1 | 0.19 | 0.23 | 1.52 | 2.2 | 0.9 | 0.08 | 0.005 | 0.13 | 0.4 | 0.3 | b | 16.445 | 2.65 |
| | 28 | 13 | 4.9 | 23.1 | 16.2 | — | — | 0.18 | 1.48 | 2.1 | 0.9 | 0.09 | 0.006 | 0.13 | 0.34 | 0.27 | b | 16.2 | 2.55 |
| | 29 | 12.8 | 4.8 | 22.3 | 13.8 | 4.2 | — | 0.18 | 1.45 | 1.8 | 1.2 | 0.07 | 0.005 | 0.12 | 0.3 | 0.24 | b | 15.9 | 2.4 |
| | 30 | 12.2 | — | 21.3 | 13.5 | 9.2 | 0.22 | — | — | — | — | 0.07 | — | — | 0.26 | 0.31 | b | 18.21 | 0 |
| | 31 | 12.9 | — | 22.3 | 12.7 | 5.7 | 0.36 | 0.2 | 1.42 | — | — | 0.06 | — | — | 0.33 | 0.24 | b | 15.73 | 0 |
| | 32 | 12.9 | — | 20.4 | 11.8 | 6.2 | 0.15 | 0.22 | 1.41 | 1.8 | 1.2 | 0.07 | — | — | 0.3 | 0.24 | b | 14.975 | 2.4 |
| | 33 | 13 | — | 21.2 | 12.8 | 6.4 | 0.17 | 0.22 | 1.56 | 2 | 0.8 | 0.07 | 0.006 | 0.12 | 0.31 | 0.34 | b | 16.085 | 2.4 |
| Comparative Example | 1 | 21.1 | 0.7 | 24.6 | 0.6 | — | — | 1 | 1.8 | 2.1 | — | 0.04 | — | — | 0.33 | 0.26 | b | 0.6 | 2.1 |
| | 2 | 12.5 | — | 22.3 | 8.8 | — | — | 0.9 | 0.3 | — | — | 0.07 | — | — | 0.24 | 0.16 | b | 8.8 | 0 |
| | 3 | — | 2.5 | 21.5 | 8.6 | — | — | 0.22 | 0.24 | 3.7 | — | 0.02 | — | — | 0.3 | 0.33 | b | 8.6 | 3.7 |
| | 4 | — | 22.8 | 22.7 | — | 7.2 | — | — | 0.1 | 0.2 | — | 0.09 | — | — | 0.33 | 0.95 | b | 3.6 | 0.2 |
| | 5 | — | 0.15 | 12.7 | 4.4 | — | — | 6.11 | 0.78 | 1.6 | 0.6 | 0.06 | — | — | 0.17 | 0.09 | b | 4.4 | 1.9 |
| | 6 | 12.4 | — | 18.7 | 6.1 | 1.2 | — | 2.02 | 2.89 | — | — | — | — | — | 0.2 | 0.1 | b | 6.5 | 0 |
| | 7 | — | 7.2 | 15.9 | — | — | — | 0.74 | 2.4 | 0.9 | — | 0.04 | — | — | 0.22 | 0.47 | b | 0 | 0.9 |
| | 8 | 9.8 | — | 19.7 | 9.9 | — | — | 1.03 | 2.63 | — | — | 0.14 | — | — | 0.48 | 0.44 | b | 9.9 | 0 |
| | 9 | — | 18.5 | 18.6 | 3.1 | — | — | 0.41 | 0.92 | — | — | 0.04 | — | — | 0.33 | 0.21 | b | 3.1 | 4.8 |
| | 10 | 12.7 | 5.2 | 10.8 | 13.2 | — | — | — | — | — | — | 0.08 | — | — | 0.3 | 0.23 | b | 13.2 | 0 |
| | 11 | 13.1 | 4.9 | 27.9 | 13.3 | — | — | — | — | — | — | 0.07 | — | — | 0.32 | 0.21 | b | 13.3 | 0 |
| | 12 | 13.6 | 5.1 | 21.6 | 4.8 | 2.1 | — | — | — | — | — | 0.08 | — | — | 0.3 | 0.28 | b | 5.85 | 0 |
| | 13 | 12.8 | 5 | 21.5 | 19.8 | 10.3 | 1.9 | — | — | — | — | 0.09 | — | — | 0.38 | 0.31 | b | 25.9 | 0 |
| | 14 | 13 | 4.8 | 22.1 | 12.8 | 6.4 | 0.21 | 0.21 | 0.05 | — | — | 0.08 | — | — | 0.41 | 0.34 | b | 16.105 | 0 |
| | 15 | 13.2 | 5.1 | 22 | 12.6 | 6.2 | 0.22 | 0.22 | 3.48 | — | — | 0.07 | — | — | 0.36 | 0.23 | b | 15.81 | 0 |
| | 16 | 13.4 | 5 | 23.1 | 13.3 | 5.8 | 0.39 | 0.22 | 1.53 | 3.7 | 2.1 | 0.09 | — | — | 0.29 | 0.21 | b | 16.395 | 4.75 |
| | 17 | 12.8 | 4.9 | 22.7 | 13 | 6.2 | 0.36 | 0.2 | 1.47 | — | — | 0.07 | 0.033 | — | 0.35 | 0.22 | b | 16.28 | 0 |
| | 18 | 13.1 | 4.8 | 22.8 | 13.2 | 6.3 | 0.38 | 0.19 | 1.51 | — | — | 0.08 | — | 0.24 | 0.37 | 0.21 | b | 16.54 | 0 |

| | No. | Heat Treatment | Composition No. and Note |
|---|---|---|---|
| Example | 1 | 1100~1200° C. × 4 hr; Water Cooling | M1 |
| | 2 | 1100~1200° C. × 4 hr; Water Cooling | M1 |
| | 3 | 1100~1200° C. × 4 hr; Water Cooling | M1 |
| | 4 | 1100~1200° C. × 4 hr; Water Cooling | M1 |
| | 5 | 1100~1200° C. × 4 hr; Water Cooling | M1 |
| | 6 | 1100~1200° C. × 4 hr; Water Cooling | M1 |
| | 7 | 1100~1200° C. × 4 hr; Water Cooling | M1 |
| | 8 | 1100~1200° C. × 4 hr; Water Cooling + 700~800° C. × 16 hr; Air Cooling | M2 |
| | 9 | 1100~1200° C. × 4 hr; Water Cooling + 700~800° C. × 16 hr; Air Cooling | M2 |
| | 10 | 1100~1200° C. × 4 hr; Water Cooling | M3 |
| | 11 | 1100~1200° C. × 4 hr; Water Cooling | M3 |
| | 12 | 1100~1200° C. × 4 hr; Water Cooling | M3 |
| | 13 | 1100~1200° C. × 4 hr; Water Cooling | M4 |
| | 14 | 1100~1200° C. × 4 hr; Water Cooling | M4 |
| | 15 | 1100~1200° C. × 4 hr; Water Cooling | M5 |
| | 16 | 1100~1200° C. × 4 hr; Water Cooling | M5 |
| | 17 | 1100~1200° C. × 4 hr; Water Cooling + 700~800° C. × 16 hr; Air Cooling | M6 |
| | 18 | 1100~1200° C. × 4 hr; Water Cooling + 700~800° C. × 16 hr; Air Cooling | M7 |
| | 19 | 1100~1200° C. × 4 hr; Water Cooling + 700~800° C. × 16 hr; Air Cooling | M8 |
| | 20 | 1100~1200° C. × 4 hr; Water Cooling | M9 |
| | 21 | 1100~1200° C. × 4 hr; Water Cooling | M10 |
| | 22 | 1100~1200° C. × 4 hr; Water Cooling | M11 |
| | 23 | 1100~1200° C. × 4 hr; Water Cooling + 700~800° C. × 16 hr; Air Cooling | M12 |

TABLE 1-continued

| | | | |
|---|---|---|---|
| | 24 | 1100~1200° C. × 4 hr; Water Cooling + 700~800° C. × 16 hr; Air Cooling | M13 |
| | 25 | 1100~1200° C. × 4 hr; Water Cooling + 700~800° C. × 16 hr; Air Cooling | M14 |
| | 26 | 1100~1200° C. × 4 hr; Water Cooling | M15 |
| | 27 | 1100~1200° C. × 4 hr; Water Cooling + 700~800° C. × 16 hr; Air Cooling | M16 |
| | 28 | 1100~1200° C. × 4 hr; Water Cooling + 700~800° C. × 16 hr; Air Cooling | M16 |
| | 29 | 1100~1200° C. × 4 hr; Water Cooling + 700~800° C. × 16 hr; Air Cooling | M16 |
| | 30 | 1100~1200° C. × 4 hr; Water Cooling | M1 |
| | 31 | 1100~1200° C. × 4 hr; Water Cooling + 700~800° C. × 16 hr; Air Cooling | M2 |
| | 32 | 1100~1200° C. × 4 hr; Water Cooling + 700~800° C. × 16 hr; Air Cooling | M6 |
| | 33 | 1100~1200° C. × 4 hr; Water Cooling + 700~800° C. × 16 hr; Air Cooling | M16 |
| Comparative Example | 1 | 1150° C. × 1 hr; Water Cooling + 800° C. × 16 hr; Air Cooling | IN740 |
| | 2 | 1180° C. × 4 hr; Water Cooling + 750° C. × 16 hr; Air Cooling | IN617 |
| | 3 | 1040° C. × 1 hr; Water Cooling + 700° C. × 16 hr; Air Cooling | IN625 |
| | 4 | 1200° C. × 1 hr; Water Cooling | HR6W |
| | 5 | 1180° C. × 2 hr; Air Cooling + 925° C. × 16 hr; Air Cooling | IN713C |
| | 6 | 1105° C. × 4 hr; Oil Cooling + 840° C. × 24 hr; Air Cooling + 760° C. × 16 hr; Air Cooling | U520 |
| | 7 | 1150° C. × 2 hr; Air Cooling + 840° C. × 24 hr; Air Cooling + 705° C. × 20 hr; Air Cooling | X-750 |
| | 8 | 1040° C. × 4 hr; Air Cooling + 705° C. × 16 hr; Air Cooling | M252 |
| | 9 | 980° C. × 1 hr; Oil Cooling + 720° C. × 8 hr; Furnace Cooling + 620° C. × 8 hr; Air Cooling | IN718 |
| | 10 | 1100~1200° C. × 4 hr; Water Cooling | Cr below lower limit |
| | 11 | 1100~1200° C. × 4 hr; Water Cooling | Cr over upper limit |
| | 12 | 1100~1200° C. × 4 hr; Water Cooling | Mo + (W + Re)/2 below lower limit |
| | 13 | 1100~1200° C. × 4 hr; Water Cooling | Mo + (W + Re)/2 over upper limit |
| | 14 | 1100~1200° C. × 4 hr; Water Cooling + 700-800° C. × 16 hr; Air Cooling | Ti below lower limit |
| | 15 | 1100~1200° C. × 4 hr; Water Cooling + 700-800° C. × 16 hr; Air Cooling | Ti over upper limit |
| | 16 | 1100~1200° C. × 4 hr; Water Cooling + 700-800° C. × 16 hr; Air Cooling | Nb + Ta/2 over upper limit |
| | 17 | 1100~1200° C. × 4 hr; Water Cooling + 700-800° C. × 16 hr; Air Cooling | B over upper limit |
| | 18 | 1100~1200° C. × 4 hr; Water Cooling + 700-800° C. × 16 hr; Air Cooling | Zr over upper limit |

b = balance (wt %)

(Creep Rupture Test)

In the creep rupture test, the Ni-base alloys, each being 20 kg, corresponding to samples No. 1 to No. 33 as the examples and samples No. 1 to No. 18 as the comparative examples, with each having the chemical composition shown in Table 1 were dissolved in a vacuum melting furnace and cast in a die. Then, the solidified ingot was forged with a forging ratio of 3 and then subjected to a predetermined thermal process. As a result, specimens of a predetermined size were produced.

TABLE 2

| | No. | Creep rupture Time(hr) (730° C. × 300 MPa) | Creep rupture elongation(%) (730° C. × 300 MPa) | Hot workable temperature range (° C.) | Increase amount due to steam oxidation(mg/cm $^2$) (700° C. × 3000 hr) | Average thermal expansion coefficient (×$10^{-6}$/° C.) (room temperature~700° C.) | Presence/absence of crack due to welding (Bead-on Welding)(*) |
|---|---|---|---|---|---|---|---|
| Example | 1 | 1185.6 | 16.4 | 245 | 0.89 | 14.4 | without |
| | 2 | 1206.8 | 15.5 | 250 | 0.92 | 14.3 | without |
| | 3 | 1398.5 | 15.5 | 250 | 0.88 | 14.1 | without |
| | 4 | 1620.7 | 16.2 | 250 | 0.9 | 13.1 | without |
| | 5 | 1613.8 | 14.9 | 255 | 0.91 | 14.5 | without |
| | 6 | 1702.9 | 15.2 | 250 | 0.85 | 13.7 | without |
| | 7 | 1793.6 | 15.5 | 250 | 0.86 | 13.1 | without |
| | 8 | 2001.6 | 12.8 | 240 | 0.72 | 13.8 | without |
| | 9 | 2231.7 | 12.6 | 200 | 0.75 | 13.6 | without |
| | 10 | 1897.5 | 13.4 | 250 | 0.88 | 14.3 | without |
| | 11 | 1990.8 | 13.8 | 245 | 0.9 | 14.1 | without |
| | 12 | 2106.3 | 13.5 | 250 | 0.9 | 13.9 | without |
| | 13 | 1903.6 | 10.6 | 240 | 0.85 | 14 | without |
| | 14 | 2004.7 | 11.5 | 245 | 0.86 | 14.2 | without |
| | 15 | 1998.5 | 10.8 | 255 | 0.92 | 14.1 | without |
| | 16 | 2009.7 | 10.8 | 250 | 0.95 | 14.3 | without |
| | 17 | 2439.2 | 8.3 | 195 | 0.73 | 13.1 | without |
| | 18 | 2543.7 | 11.6 | 200 | 0.72 | 13.3 | without |
| | 19 | 2478.3 | 11.2 | 200 | 0.75 | 13.9 | without |
| | 20 | 2189.7 | 12.6 | 245 | 0.9 | 14.1 | without |
| | 21 | 2200.6 | 12.8 | 240 | 0.85 | 14.5 | without |
| | 22 | 1998.9 | 10.6 | 250 | 0.86 | 13.8 | without |
| | 23 | 2303.7 | 9.8 | 200 | 0.73 | 13.4 | without |
| | 24 | 2230.7 | 9.4 | 195 | 0.75 | 13.6 | without |
| | 25 | 2627.3 | 9.4 | 205 | 0.76 | 13.8 | without |
| | 26 | 2306.9 | 12.6 | 250 | 0.85 | 14.1 | without |
| | 27 | 2496.8 | 11 | 200 | 0.72 | 13.6 | without |
| | 28 | 2543.9 | 9.6 | 195 | 0.75 | 13.7 | without |
| | 29 | 2504.9 | 9.8 | 200 | 0.77 | 13.4 | without |
| | 30 | 1812.2 | 14.9 | 240 | 0.81 | 14 | without |

TABLE 2-continued

| | No. | Creep rupture Time(hr) (730° C. × 300 MPa) | Creep rupture elongation(%) (730° C. × 300 MPa) | Hot workable temperature range (° C.) | Increase amount due to steam oxidation(mg/cm $^2$) (700° C. × 3000 hr) | Average thermal expansion coefficient (×$10^{-6}$/° C.) (room temperature~700° C.) | Presence/absence of crack due to welding (Bead-on Welding)(*) |
|---|---|---|---|---|---|---|---|
| | 31 | 2319.5 | 12.2 | 195 | 0.73 | 13.9 | without |
| | 32 | 2498.7 | 8 | 190 | 0.7 | 13.4 | without |
| | 33 | 2521.3 | 11.2 | 195 | 0.7 | 13.8 | without |
| Comparative Example | 1 | 1523.6 | 3.2 | 165 | 0.9 | 15.2 | without |
| | 2 | 689.4 | 11.8 | 205 | 0.65 | 15.6 | without |
| | 3 | 403.2 | 13.8 | 230 | 0.78 | 15.1 | without |
| | 4 | 232.5 | 21.2 | 245 | 0.9 | 15.7 | without |
| | 5 | 14089.5 | 2.8 | 20 | 2.52 | 14.3 | — |
| | 6 | 5982.8 | 4.2 | 95 | 1.1 | 15.5 | — |
| | 7 | 989.6 | 15.6 | 155 | 1.6 | 15.8 | — |
| | 8 | 1450.8 | 20.5 | 136 | 1.52 | 13.9 | — |
| | 9 | 295.8 | 20.8 | 200 | 1.3 | 15.8 | — |
| | 10 | 1105.8 | 16.8 | 145 | 2.8 | 13.3 | without |
| | 11 | 1545.9 | 12.2 | 245 | 0.61 | 16.8 | without |
| | 12 | 305.7 | 15.8 | 240 | 0.91 | 15.6 | without |
| | 13 | 2168.5 | 4.5 | 250 | 0.92 | 12.1 | without |
| | 14 | 567.3 | 15.4 | 240 | 0.88 | 13.5 | without |
| | 15 | 2438.5 | 5.2 | 125 | 0.95 | 12.9 | with |
| | 16 | 2459.2 | 4.5 | 200 | 0.92 | 13.4 | with |
| | 17 | 2712.9 | 9.8 | 200 | 0.95 | 13.8 | with |
| | 18 | 2689.6 | 9.5 | 205 | 0.92 | 13.3 | with |

(*)Since most of high-temperature cracks are formed in welded metals, bead-on welding is often employed for evaluation as simple method.

For each sample, a creep rupture test was conducted under the conditions of 730° C. and 300 MPa. The creep rupture test was conducted based on JIS Z 2271 (a method for creep and creep rupture test for metallic materials). Table 2 shows creep rupture time (hr) and creep rupture elongation (%) which were obtained as properties obtained in the creep rupture test.

It is clear from the results shown in Table 2 that samples No. 1 to No. 33 of the examples got significant increases in creep rupture time and improvements in creep rupture strength compared with the conventional alloys of the comparative examples' sample No. 2 (corresponding to IN617), sample No. 3 (corresponding to IN625), sample No. 4 (corresponding to HR6W) and sample No. 9 (corresponding to IN718).

Moreover, samples No. 1 to No. 33 of the examples got significant improvements in creep rupture elongation compared with the conventional alloys of the comparative examples' sample No. 1 (corresponding to IN740), sample No. 5 (corresponding to IN713C) and sample No. 6 (corresponding to U520).

Moreover, compared with the comparative example No. 12 that drops below the lower limit of the chemical composition range of the present invention in Mo+(W+Re)/2 or the comparative example No. 14 that drops below the lower limit of the chemical composition range of the present invention in Ti, samples No. 1 to No. 33 of the examples got significant increases in creep rupture time and improvements in creep rupture strength.

Meanwhile, comparative examples No. 13, No. 15 and No. 16, which exceed the upper limit of the chemical composition range of the present invention in Mo+(W+Re)/2, Ti and Nb+Ta/2, got improvements in creep rupture time. However, the creep rupture elongation of comparative examples No. 13, No. 15 and No. 16 decreased significantly.

(Hot Workability Test)

In the hot workability test, as in the creep rupture test, round-bar specimens with a 10-mm diameter and a 120-mm length were taken from the Ni-base alloys of samples No. 1 to No. 33 as the examples and samples No. 1 to No. 18 as the comparative examples, with each having the chemical composition shown in Table 1. Then, the Gleeble test (high-temperature, high-speed tensile test) was conducted at each temperature between 1,000 and 1,400° C. and the contraction of area was measured. Subsequently, the width of the temperature range where the contraction of area is greater than 50% was calculated. The width of the hot workable temperature range serves as an index of hot workability. Table 2 shows the results.

It is clear that samples No. 1 to No. 33 of the examples got significant increases in the width of the hot workable temperature range and improvements in hot workability compared with the conventional alloys of the comparative examples' sample No. 1 (corresponding to IN740), sample No. 5 (corresponding to IN713C), sample No. 6 (corresponding to U520), sample No. 7 (corresponding to X-750) and sample No. 8 (corresponding to M252).

Moreover, compared with the comparative example No. 15 that exceeds the upper limit of the chemical composition range of the present invention in Ti, samples No. 1 to No. 33 of the examples got significant increases in the width of the hot workable temperature range and improvements in hot workability.

(Steam Oxidation Test)

In the steam oxidation test, as in the creep rupture test and the hot workability test, specimens with a 10-mm width, a 15-mm length and 3-mm in thickness were taken from the Ni-base alloys corresponding to samples No. 1 to No. 33 as the examples and samples No. 1 to No. 18 as the comparative examples, with each having the chemical composition shown in Table 1. The specimens were exposed to the steam environment whose temperature is 700° C. for 3,000 hours. An increase in amount (mg/cm2) due to the oxidation after the exposure was measured. The results are shown in Table 2.

It is clear that the increase amounts due to the steam oxidation of samples No. 1 to No. 33 of the examples were substantially equal to those of the conventional alloys of the comparative examples' sample No. 2 (corresponding to IN617) and sample No. 3 (corresponding to IN625) and that samples No. 1 to No. 33 of the examples have good steam oxidation resistance. Moreover, samples No. 1 to No. 33 of the examples were significantly small in the increase amounts due to the steam oxidation and got significant improvements in steam oxidation resistance, compared with the conventional alloys of the comparative examples' sample No. 5 (corresponding to IN713C) and sample No. 7 (corresponding to X-750) and the comparative example No. 10 that drops below the lower limit of the chemical composition range of the present invention in Cr.

(Measurement of Average Thermal Expansion Coefficient)

In the measurement of average thermal expansion coefficients, as in the creep rupture test, the hot workability test and the steam oxidation test, round-rod specimens with a 5-mm diameter and a 19-mm length were taken from the Ni-base alloys corresponding to samples No. 1 to No. 33 as the examples and samples No. 1 to No. 18 as the comparative examples, with each having the chemical composition shown in Table 1. Then, the average thermal expansion coefficients were measured by using a thermomechanical analysis apparatus manufactured by Rigaku Corporation. Quartz was used as a standard reference material. The average thermal expansion coefficients in the range of room temperature to 700° C. were measured under the condition of temperature increase rate of 5° C. per minute by a differential expansion method. The results are shown in Table 2.

It is clear that samples No. 1 to No. 33 of the examples have the smaller average thermal expansion coefficients in the range of room temperature to 700° C. compared with the comparative examples' sample No. 1 (corresponding to IN740), sample No. 2 (corresponding to IN617), sample No. 3 (corresponding to IN625), sample No. 4 (corresponding to HR6W), sample No. 6 (corresponding to U520), sample No. 7 (corresponding to X-750) and sample No. 9 (corresponding to IN718).

Moreover, it is clear that samples No. 1 to No. 33 of the examples have the smaller average thermal expansion coefficients in the range of room temperature to 700° C. compared with the comparative example No. 11 that exceeds the upper limit of the chemical composition range of the present invention in Cr and the comparative example No. 12 that drops below the lower limit of the chemical composition range of the present invention in Mo+(W+Re)/2.

(Weldability Test)

In the weldability test, as in the creep rupture test, the hot workability test, the steam oxidation test and the measurement of average thermal expansion coefficients, flat plates with a 150-mm length, an 80-mm width and a 20-mm thickness were fabricated from the Ni-base alloys corresponding to samples No. 1 to No. 33 as the examples and samples No. 1 to No. 18 as the comparative examples, with each having the chemical composition shown in Table 1. The surfaces of the flat plates were subjected to 3-pass welding by predetermined welding rods, and thereafter, the presence/absence of the occurrence of a crack was examined on five sections vertical to weld beads. The results are shown in Table 2.

Incidentally, as for the presence/absence of the crack occurrence, "without" represents that crack occurrence was not confirmed in any of the five sections, and "with" represents that the crack occurrence was confirmed in one section or more out of the five sections.

Samples No. 1 to No. 33 as the examples were all "without". Further, sample No. 1 (corresponding to IN740), sample No. 2 (corresponding to IN617), sample No. 3 (corresponding to IN625) and sample No. 4 (corresponding to HR6W) as comparative example were also "without".

Moreover, the comparative example No. 10 that drops below the lower limit of the chemical composition range of the present invention in Cr, the comparative example No. 11 that exceeds the upper limit, the comparative example No. 12 that drops below the lower limit of the chemical composition range of the present invention in Mo+(W+Re)/2, the comparative example No. 13 that exceeds the upper limit, and the comparative example No. 14 that drops below the lower limit of the chemical composition range of the present invention in Ti were all "without".

However, the comparative example No. 15 that exceeds the upper limit of the chemical composition range of the present invention in Ti, the comparative example No. 16 that exceeds the upper limit of the chemical composition range of the present invention in Nb+Ta/2, the comparative example No. 17 that exceeds the upper limit of the chemical composition range of the present invention in B, and the comparative example No. 18 that exceeds the upper limit of the chemical composition range of the present invention in Zr were all "with".

Incidentally, the comparative example No. 5 (corresponding to IN713C), the comparative example No. 6 (corresponding to U520), the comparative example No. 7 (corresponding to X-750), the comparative example No. 8 (corresponding to M252), and the comparative example No. 9 (corresponding to IN718) are applied to such components as rotor blades, stator blades and tie bolts that go through forging or some form of plastic deformation when being processed. Since the above components are not welded, no weldability tests were conducted for the above components.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A nickel-base alloy comprising, in weight %:
nickel (Ni),
from 0.08 to 0.2 of carbon (C),
from 0.1 to 1 of silicon (Si),
from 0.1 to 1 of manganese (Mn),
from greater than 10 to less than or equal to 17 of cobalt (Co),
from greater than or equal to 4.6 to less than 7.5 of iron (Fe),
from 21.2 to 25 of chromium (Cr),
from 0.23 to 0.4 of aluminum (Al),
from greater than 1.0 to less than or equal to 2.5 of titanium (Ti), and
a total of 4.2 to 10.1 of tungsten (W) and rhenium (Re), and, optionally molybdenum (Mo), wherein Mo+(W+Re)/2 is from 15.46 to 25, wherein
the nickel-base alloy exhibits a hot workable temperature range of from 205-225° C.

2. The nickel-base alloy according to claim 1, wherein cobalt (Co) is present in an amount of from greater than 10 to less than or equal to 14 weight %.

3. The nickel-base alloy according to claim 1, wherein cobalt (Co) is present in an amount of from 12.6 to less than or equal to 14 weight %.

4. The nickel-base alloy according to claim 1, wherein a solution heat treatment and an aging treatment are conducted.

5. A steam turbine component comprising the nickel-base alloy according to claim 1.

6. The nickel-base alloy according to claim 1, wherein carbon (C) is present in an amount of from 0.08 to 0.15 weight %.

7. The nickel-base alloy according to claim 1, wherein carbon (C) is present in an amount of from 0.08 to 0.10 weight %.

8. The nickel-base alloy according to claim 1, wherein silicon (Si) is present in an amount of from 0.1 to 0.5 weight %.

9. The nickel-base alloy according to claim 1, wherein silicon (Si) is present in an amount of from 0.1 to 0.4 weight %.

10. The nickel-base alloy according to claim 1, wherein manganese (Mn) is present in an amount of from 0.1 to 0.4 weight %.

11. The nickel-base alloy according to claim 1, wherein manganese (Mn) is present in an amount of from 0.2 to 0.3 weight %.

12. The nickel-base alloy according to claim 1, wherein iron (Fe) is present in an amount of from 4.6 to 6 weight %.

13. The nickel-base alloy according to claim 1, wherein iron (Fe) is present in an amount of from 4.6 to 5 weight %.

14. The nickel-base alloy according to claim 1, wherein chromium (Cr) is present in an amount of from 21.6 to 23.1 weight %.

15. The nickel-base alloy according to claim 1, wherein chromium (Cr) is present in an amount of from 21.6 to 22.3 weight %.

16. The nickel-base alloy according to claim 1, wherein aluminum (Al) is present in an amount of from 0.23 to 0.3 weight %.

17. The nickel-base alloy according to claim 1, wherein aluminum (Al) is present in an amount of from 0.23 to 0.25 weight %.

18. The nickel-base alloy according to claim 1, wherein titanium (Ti) is present in an amount of from greater than 1.0 to less than or equal to 2.0 weight %.

19. The nickel-base alloy according to claim 1, wherein titanium (Ti) is present in an amount of from greater than 1.0 to less than or equal to 1.6 weight %.

* * * * *